United States Patent [19]

Lees

[11] Patent Number: 4,610,571

[45] Date of Patent: Sep. 9, 1986

[54] FOUNDATION SYSTEM AND PILE COUPLING FOR USE THEREIN

[75] Inventor: Ralph J. Lees, Scarborough, Me.

[73] Assignee: Braman, Dow and Company, Boston, Mass.

[21] Appl. No.: 787,060

[22] Filed: Oct. 15, 1985

[51] Int. Cl.[4] ..... E02D 5/16

[52] U.S. Cl. ..... 405/251; 405/257; 285/317; 403/306; 403/328

[58] Field of Search ..... 405/250, 251, 252, 257; 285/321, 317, 417, 404; 403/306, 327, 328, 329, 305, 300, 108

[56] References Cited

U.S. PATENT DOCUMENTS

| | | | |
|---|---|---|---|
| 502,686 | 8/1893 | Tilton | 403/300 |
| 738,503 | 9/1903 | Waters | 285/321 |
| 755,325 | 3/1904 | Soutar | 285/317 |
| 2,075,483 | 3/1937 | Trotter | 403/328 |
| 3,326,580 | 6/1967 | Munier | 285/321 |
| 3,336,060 | 8/1967 | Bradford | 403/108 |

FOREIGN PATENT DOCUMENTS

| | | | |
|---|---|---|---|
| 1373288 | 4/1964 | France | 403/300 |

*Primary Examiner*—Cornelius J. Husar
*Assistant Examiner*—Kristina I. Hall
*Attorney, Agent, or Firm*—Richard P. Crowley

[57] ABSTRACT

A foundation system which includes the use of a coupled piling of solid bars for supporting a structure in which the solid bars are coupled together in a contacting relationship. The coupled piling bars comprise a first and a second solid bar, one end of the first bar and the other end of the second bar adapted to be placed in an aligned, contacting, supporting relationship, each bar having a pin-retaining cavity spaced apart a short distance from the end of each bar, and each end having a pin-retaining ring-receiving cavity at each opposing end of the bar, to receive a pin-retaining ring. The first and second bars are coupled together through an outer housing which fits over the outer surface of the opposing ends of the first and second bars, and containing first and second pins and springs, to bias the pins inwardly toward the center of the coupling, and retaining-pin rings in the housing, to retain the first and second pins in an open tensioned position. When the first end of one bar and the other end of the second bar are slid into closing contact, the retaining ring fits in the retaining-ring cavity, and the first and second pins slide into the respective pin-receiving cavities at the end of each bar, to retain the solid bars in a close, supporting, aligned position.

19 Claims, 5 Drawing Figures

FOUNDATION SYSTEM AND PILE COUPLING FOR USE THEREIN

BACKGROUND OF THE INVENTION

Foundation systems typically employ piles driven into bedrock or below, in order to provide support for a foundation. Often, it is necessary to drive piles of a defined length into the ground and to bedrock employing cranes and pile-driving equipment. Where there is a limitation on the employment of pile-driving equipment or cranes, such as a limitation on height, and where prior pile-driving is not practical, a system known as the minipile system has been employed comprising a plurality of solid metal bar pilings coupled together through threaded connections at the end of each bar. Such a system is particularly adapted for use in putting support pilings into existing foundations and facilities.

Generally, the system comprises providing a load-bearing coupled pile system for foundations, by drilling a substantially vertical hole in the ground, employing an outer casing drill, such as, for example, 8 to 10 inches, and an inner counter-rotating pile drill of 4 to 6 inches, and drilling a hole through to bedrock or, for example, up to 20 feet into the bedrock. A hollow casing is then inserted into the drilled hole, and later solid metal pile rods of a length, depending on the space available, and typically ranging from 4 to 15 feet, are coupled together at their ends, to connect together the round, solid-steel pile rods or bars. The coupled bars or rods are then lowered into the pipe casing and inserted or driven into the ground, in order to provide a supported load-bearing function for the foundation.

The piles are coupled together merely to hold the sections of the bars together, while they are lowered into the pipe casing. Typically, spacers, such as plastic spacers, are employed at defined lengths, for example 10 feet, within the pipe casings, to provide for generaly vertical alignment of the coupled rods or bars within the pipe casings. For example, strength is a significant factor in such a system, since a solid bar; for example 6¼ inches in diameter, weighs approximately 105 pounds per linear feet and at, for example, a 160-foot depth, approximately 8½ tons are to be carried by the upper couplings, so that all pile couplings are designed to carry the total weight of the foundation, regardless if it is an upper or a lower coupled pile. After the coupled bars are lowered into the pipe casing and the lower end of the bar is resting on bedrock or below, the pipe casing around the bar is filled or injected with a liquid concrete between the outside diameter of the bar and the inside diameter of the pipe casing, thereby providing a foundation system. On hardening of the concrete within the pipe casing, the couplings employed in securing the bars together no longer have any affect on the installation of the bars.

In one present system, threaded couplings are employed at each end of the solid-steel bars being used, which threaded couplings require time-consuming and costly machining of the bars at each end, plus manufacturing the threaded coupling, in order to provide for a threaded connection between the bars. The present coupling system being used also requires a starting thread at the end of each bar and screwing the coupling onto each end of the bars, to join together the coupled bars. If the bars are not aligned almost perfectly, then the threads will not engage and may become cross-threaded. In addition and importantly, such a threaded system requires a careful control of the tension, since the weight of the bar or rod must be maintained such that not too much weight is placed on the upper end of the bar being threaded, since, if too much weight is applied, there is danger of deforming the threads on the bar.

Furthermore, in the threaded pile-coupling system, each of the bars is required, typically by code or by architectural design, to have 99% or over contact between the ends of the bars, so as to prevent any even slight movement of the bars, once a load-bearing structure is applied. The system of turning a threaded coupling onto the end of a threaded bar and then screwing another threaded bar into this coupling presents a practical problem, in that it is difficult to ascertain and prove that the two threaded bars at the end are in full support and load-bearing contact with each other across the entire end area. Presently, in order to insure such contact, a hole is machined into the threaded coupling at midpoint, which hole is employed as an inspection hole, to permit visual inspection of each bar, to ascertain that there is full end bar-to-bar contact after the threading operation. Thus, the threaded-coupling system, while avoiding some of the difficulties associated with pile-driving, requires expensive machining of the couplings expensive machining of the bars, possible damage to the threads due to handing during the threading operation, the slow assembly of the coupling to the bar and the need to make visual inspection, to ascertain bar-to-bar contact.

Therefore, it is desirable to provide an improved coupling for sectional bars or piles used in foundation systems, in order to overcome the disadvantages of the present threaded-coupling system.

SUMMARY OF THE INVENTION

The invention relates to a foundation system employing coupled bars or pilings and to the coupling employed in coupling together bars and pilings. In particular, the invention concerns a fast-fit coupling system for use in connecting together solid-steel bars, in order to provide for load-bearing support for a building or other structure placed upon a series of such coupled supports used as a foundation, and to the slide-lock coupling employed to couple together the bars and to the coupled bars.

A fast-fitting, easy, simplified, coupling system has been discovered, to provide for the rapid and effective coupling together of solid bars, in order to provide support for a foundation. The coupling system of the invention comprises a slide-lock coupling system which, while still requiring machining of the bar to be employed and the preparation of a coupling, minimizes the cost and labor associated with the present time-consuming threading of the ends of the bars and of the couplings and the threading of the bars to the coupling. The present system merely requires simple grooves cut into the ends of each of the bars. The coupling system, although also requiring close alignment of the ends of the bars, provides for a much easier start, because the coupling system employed has a sliding joint; that is, coupling is achieved by axial movement toward each other of the ends of the bars, and not a threading, spiral motion of the bars. The coupling may have a chamfer, e.g. of 30°, out on the inside diameter of the ends to allow for an easy start to the penetration of the bars at both ends making alignment much less vertical than in a threaded system.

The coupling system of the invention employs locking spring-loaded ends, to make the coupled connections, rather than employing intricate threads; therefore, avoiding the need to turn about the axis the heavy bars or the threaded coupling. Further, the coupling system of the invention is so designed, so that, when the weight of the bars coupled together is pressing downwardly, the ends of the bars are assured of end bar-to-bar contact; thus, obviating the need for a visual inspection hole, as required in the threaded-coupling system. Thus, the slide-lock coupling system of the invention provides for the rapid coupling together, typically in less than 1 minute, of heavy solid bars, to form coupled piles for use in load-bearing foundation systems, and requires a minimum of machining of the bars merely by the formation of grooves, rather than threads, avoids damage to the bars due to rough handling, such bars are easily repaired, and further does not require any inspection hole, since the method of assembly, by sliding the bars together in a lock-tight assembly, and does not require visual inspection, to insure end bar-to-bar contact.

The coupling system of the invention provides for the coupling together of a plurality of typically solid metal round bars for use within a pipe casing for supporting a foundation in which the bars are coupled together in an end-aligned contacting relationship, to provide load-bearing support for the structure. The coupled pilings comprise a first and a second bar, such as a solid bar, each bar having a one and another end, the ends of the first and second bars adapted to be placed in a close, end to end, contacting, axially aligned, supporting relationship with the coupling system, except for the one end of the bar which forms the lower portion which is placed in or on the bedrock and the other end of the bar which forms the upper portion of the multiple coupled-bar structure. Each bar member has a cavity spaced about a short defined distance from the end of each of the bars, such as a rectangular-type chamfered groove extending around the periphery of the bar, the groove adapted to receive and retain a retainer, such as a pin therein. Each bar also contains at each end thereof a ring-receiving cavity, such as a ring-receiving groove, at the opposing end of each bar adapted to receive and capture a pin-retaining ring, the outer diameter of which pin-retaining ring does not extend beyond the outer diameter of the bar. Of course, if desired, the bars forming the bottom and upper bars need not have the pin cavity or the ring cavity; however, this would require that two types of bars be available at construction site, and, as a practical matter, each of the bars should have at each end the pin cavity and the ring cavity, to avoid inventorying two types of bars at construction sites.

The coupling system includes a coupling to secure together the one end of the first bar and the other end of the second bar, to form a piling coupling, with a coupling system used at each end of the bar, to extend the pile couplings to the desired length. The pile coupling comprises an outer housing having an inner diameter and surface which slidably fits in a relatively snug manner the outer diameter and surface of the opposing ends of the first and second bars to be coupled together in a slide locking manner. The housing contains in addition tensioned, spaced-apart bar retainer members, such as pin members, mounted to move from a tensioned, open, unlocked position to a less tensioned, closed, locked position and into the respective pin-retaining cavity at the end of each of the bars. The pin-retaining members are spaced apart in the housing, so as to provide for separate locking of the bars by each set of pin members, with a plurality of pin members typically employed. The pin members are tensioned, to bias the pin members inwardly toward the axis of the coupling and the axis of the bars, to be placed into a bar-retaining, closed or locked position, when each end of the bar members is slid into the housing coupling.

The coupling also includes a retaining member, typically within the housing, to retain the pin members in a biased, unlocked condition, so as to permit the one end of the first bar and the other end of the second bar to slide into opposite ends of the coupling housing, when the coupling is in a loaded or unlocked state. In operation, when the one end of the first bar and the one end of the second bar are slid within the coupling housing, the retaining ring, holding the pin members in an unlocked position, is captured and snugly slides into the ring cavity at the end of each bar; thus, permitting the tensioned pin member to move inwardly and into the retaining cavity or pin groove at the end of each bar, placing the ends of the first and second bars in a fully contacting, load-supporting, coupled, locked relationship.

The coupling system of the invention permits the easy insertion of the ends of the bar members into a slide-lock-type coupling which is initially in the unlocked or loaded state, and, by capturing and removing of the ring member which retains the tensioned pins at the end of each bar, the tensioned pins can move forward and into the end grooves, so that the bars are placed in a coupled locked relationship in an easy and effective manner, avoiding many of the difficulties and disadvantages associated with the present threaded-coupling system. The foundation system may employ a plurality of the solid-bar members coupled together in the desired manner, to form a coupled piling of the desired length which is then inserted into the casing, generally with spacers as with the threaded-coupling system, and then later cemented in place.

The invention will be described for the purpose of illustration only in connection with certain illustrative embodiments; however, it is recognized that various changes, modifications and improvements may be made by those persons skilled in the art, all falling within the spirit and scope of the invention.

DESCRIPTION OF THE EMBODIMENTS

Figure 1:
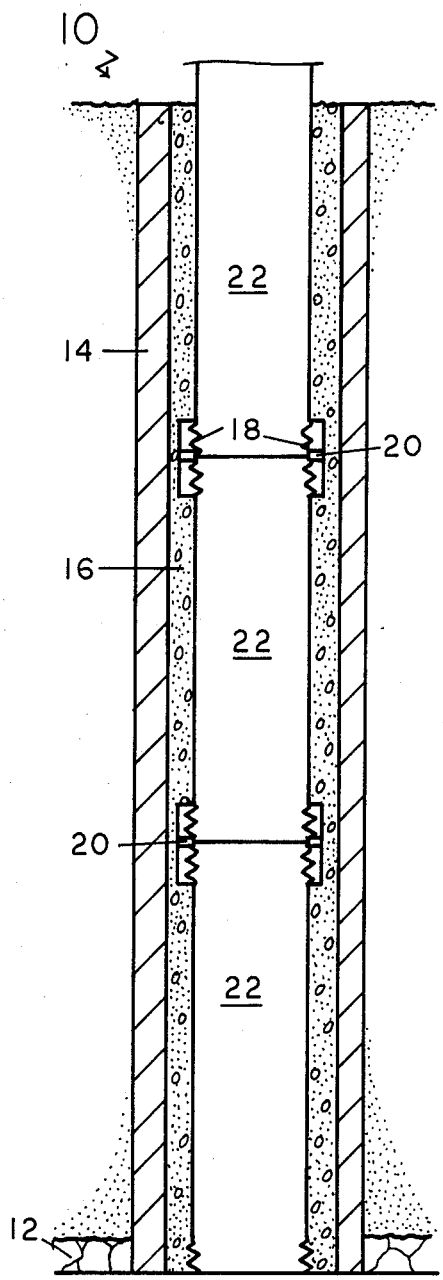
FIG. 1 PRIOR ART
FIG. 1 is an illustrative, sectional view of a prior-art foundation system employing a plurality of threaded-bar couplings.

FIG. 1 is an illustrative, sectional view of a threaded-coupling prior-art system 10, showing a plurality of threaded bars 22 coupled together by threaded couplings 18, each coupling having an inspection hole 20 for visual inspection of at least 99% bar-to-bar end contact, the threaded-bar couplings disposed within a pipe casing 14 and surrounded by hardened concrete 16, with the lower end of the bar supported on or in a bedrock 12, to provide a foundation system for the support of a load-bearing structure. As an illustrative example, the threaded bars 22 would comprise a solid metal bar of about 6 inches in diameter, while the pipe casing would be about 12 inches in diameter, with the threaded ends of the bars threaded into the coupling 18, and with the ends of the bars providing at least 99% end bar-to-bar contact.

Figure 2:
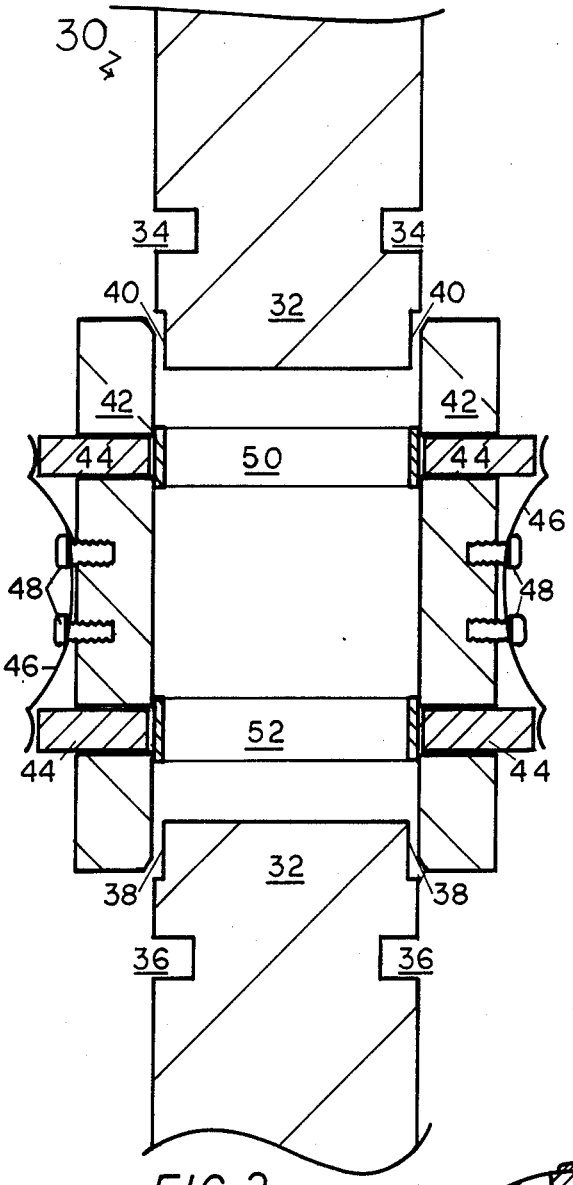
FIG. 2 is an illustrative, sectional view of the pile bar coupling of the invention, with the coupling shown in the unlocked or loaded state.

FIG. 2 is an illustrative, sectional view of the coupling system of the invention 30, showing grooved bars 32, each end of each bar having defined, generally rectangular, pin-retaining grooves 34 and 36; for example, ½ inch by ½ inch, about the external periphery of the grooved bars 32 and spaced apart from each end thereof a defined distance. The bars 32 also have at the one end thereof retaining-ring end grooves 38 and 40 ¾ths to ⅞ths of an inch in axial length, to provide a reception cavity for a pin-retaining ring. As illustrated, FIG. 2 shows a coupling housing 42 having 30° chamfered end edges for ease coupling and containing a pair of spaced-apart pins 44 in a biased or tensioned position, through the employment of spring-tensioned steel pins 44 placed in a biased or tensioned position through tension spring 46 secured by screws 48 to the exterior of the housing 42. The pins 44 are disposed in a loaded or uncoupled state through the employment of sacrificial retaining rings 50 and 52 within the coupling housing 42 and having a greater thickness than the pins 44 or the pin cavity, to maintain the pins 44 in a loaded condition to permit the ends of the bars 32 to be inserted slidably on each side of the coupled housing 42.

Figure 3:
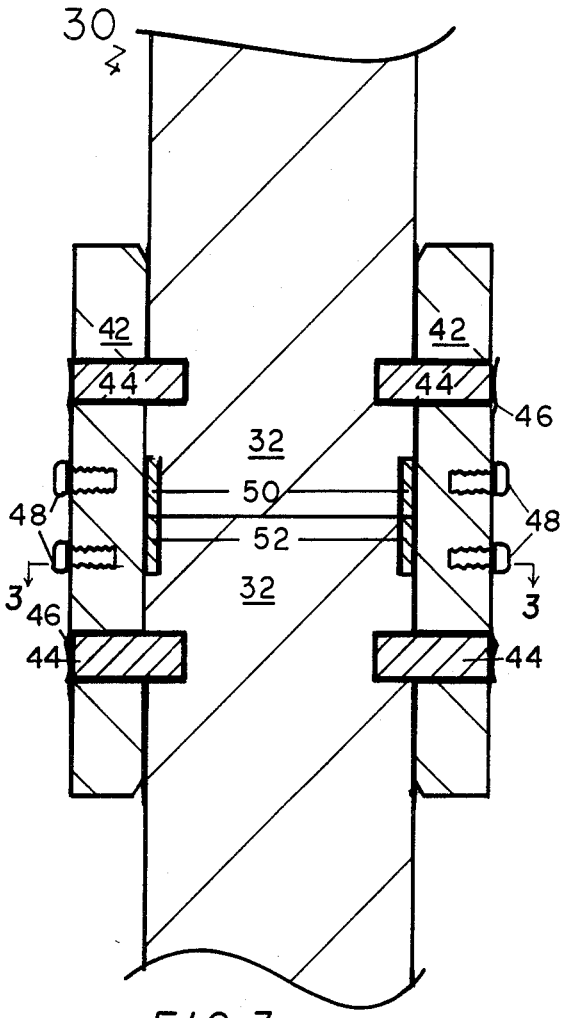
FIG. 3 is an illustrative, sectional view of the bar coupling of the invention, with the coupling shown in the locked or closed state, with the bar members in a contacting relationship.
Figure 4:
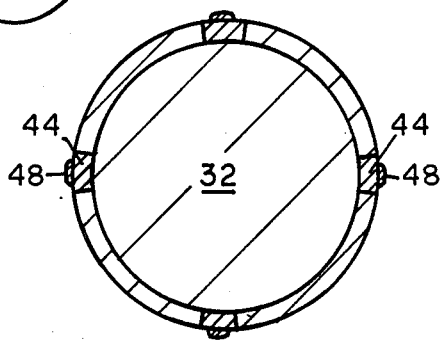
FIG. 4 is a sectional view along lines 3—3 of FIG. 3.

FIG. 3 is an illustrative, sectional view of the coupling system 30 in an unloaded or closed position, wherein the ends of bars 32 are placed in a contacting, load-supporting coupled relationship and adapted to be lowered into the casing 12 in a foundation support system. FIGS. 3 and 4 show that the ends of the bars 32 have been slid within the housing 42, and have removed the retaining rings 50 and 52, so that the retaining rings 50 and 52 are snugly fitted within the retaining-ring grooves 38 and 40 at the end of each of the bars 32, thereby removing impediment to the inward movement of the tensioned biased pins 44 inwardly, so that the pins 44 are so spaced and positioned as to be positioned within the pin grooves 34 and 36, and to lock the ends of the bars in a close, load-supporting, contacting position, with the tension spring 46 maintaining the pins 44 in a biased and tensioned position. FIG. 4 illustrates that four pins 44 equally positioned about the periphery of the housing 42 have been used; however, if desired, a plurality of pins, ranging from such as 2, 4, 6, 8, 10, etc. may be used.

Thus, in operation, the bars 32, containing the pin-retaining grooves at each end thereof and the ring cavities at the end thereof, are merely slid into the each end of the coupling housing 42, to displace the sacrificial pin-retaining rings 50 and 52 and to place the rings within the ring cavities 38 and 40, without further forward, inward, axial movement of the ends of the bars 32. The tensioned pins 34, where the bars are in contact, are forced into the retaining grooves 34 and 36, so as to place the bars in a closed or unloading position, which are suitable to be lowered into the casing 12, to form a foundation system. As illustrated, FIGS. 2, 3 and 4 are directed to the coupling at one end of the bars; however, it is recognized that a plurality of the bars 32 are connected at each end, except for the lowermost end of the bars 32 or the uppermost end of the bars 32. The number of bars 32 may vary, depending on the length of the coupled pilings required, while the diameter of the bars may vary as desired, depending on the load-supporting function.

Figure 5:
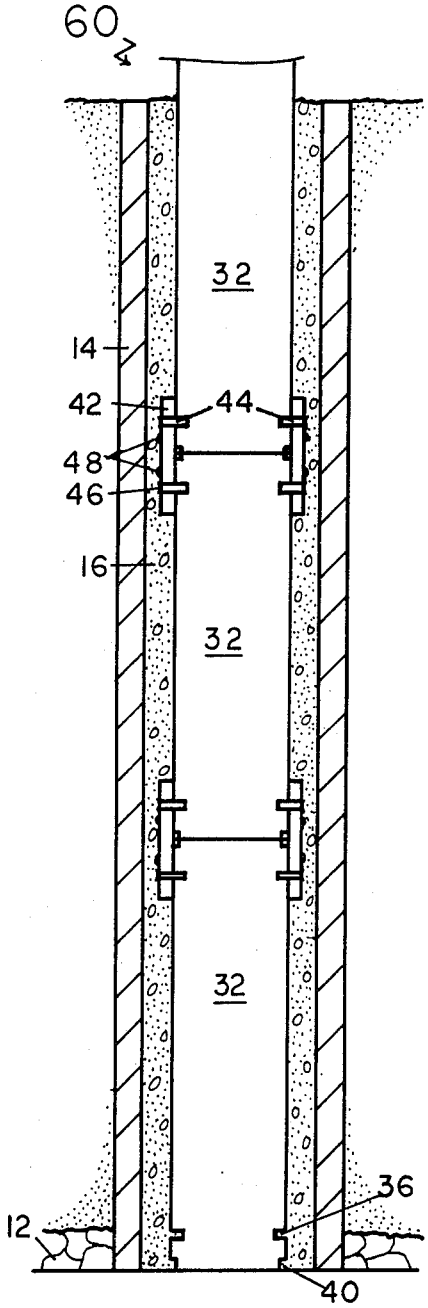
FIG. 5 is an illustrative, sectional view of a foundation system employing the slide-lock bar-coupling system of the invention.

FIG. 5 is directed to a foundation system employing the bar-coupling system of the invention 60, wherein a plurality of bars 32 are coupled together within a coupling housing 42 through the employment of tension pins 44 within grooves 34 and 36, so as to form a plurality of aligned, contacting, load-supporting bars 32 within a pile casing 12 (plastic spacers not shown) which has been filled or injected with cement 16 which has been permitted to be hardened, so as to form a load-bearing support system.

As illustrated, the bar-coupling system of the invention and the foundation system in which the bar couplings are employed provide for new, signficant and improved advantages over prior-art fitted coupling systems in both the nature of the materials employed, the ease of installation and the labor costs involved.

What is claimed is:

1. Coupled piling bars for use in forming a load-bearing support for a structural foundation, which coupled piling bars comprise:

(a) a first piling bar and a second piling bar, the first and second piling bars each having a one and another end, the one end of the first bar and the other end of the second bar characterized by a retainer-cavity means spaced apart from the end of the bar, and a retainer-ring-receiving groove means at the one end of the first bar and at the other end of the second bar and adapted to receive within the groove a retainer ring; and (b) a pile bar coupling means to secure together the one end of the first pile bar and the other end of the second pile bar in an axially aligned, contacting, load-bearing coupled relationship, which coupling means comprises (i) an outer housing means adapted to be fit slidably in a snug manner over the one end of the first bar and the second end of the second bar, (ii) first and second retainer means spaced apart from each other in the housing means and adapted to move from a biased unlocked position to a locked position, (iii) tensioning means to bias inwardly the first and second retainers toward the center of the coupling means, and (iv) first and second retainer-ring means within the housing means and positioned to retain respectively the first and second retainers in an open, tensioned, unlocked position, whereby, on insertion of the one end of the first pile bar and the other end of the second pile bar into the housing, the first and second retainer rings are received within the retainer-ring-receiving groove, through the axial inward motion of the first and second bars, and, on contact of the first and second bars, the tensioned retainer means are positioned in the retainer-cavity means, to lock together the first and second bars in an end-to-end contacting coupled relationship.

2. The piling bars of claim 1 wherein the bars comprise solid metal rods having a length of from about 4 to 15 feet.

3. The piling bars of claim 1 wherein the first and second piling bars contain a retainer-cavity means and a retainer-ring-receiving groove means at each end of the respective first and second bars.

4. The piling bars of claim 3 which include a plurality of three or more piling bars and two or more coupling means, to provide for a plurality of aligned, load-supporting piling bars for use in a foundation.

5. The piling bars of claim 1 wherein the retainer-cavity means comprises a peripheral groove spaced apart a short distance from each end of the piling bars.

6. The piling bars of claim 1 wherein the retainer-ring-receiving groove at the opposing ends of the first and second piling bars comprises a peripheral groove extending axially inward a distance at least equal to the axial thickness of retainer ring means from the ends of the first and second bars and adapted to receive in a snug manner the retainer ring means.

7. The piling bars of claim 1 wherein the first and second retainer means comprise a plurality of first and second retaining pin members respectively, and wherein the retainer-cavity means comprises a peripheral groove spaced-apart from the end of the first and second bars, the retainer pin members adapted to fit in a snug relationship, when in a locked position, within the retainer groove.

8. The piling bars of claim 1 wherein the retainer pin ring means comprises a retaining ring member having a thickness the same or greater than the thickness of the first and second retainer means, and with the outer diameter of the ring member the same or less than the outer diameter of the first and second bars.

9. The piling bars of claim 1 wherein the first and second retainer means respectively each comprise a plurality of tension-biased retainer pin members generally equally spaced about the periphery of the housing and adapted to move from a tensioned, unlocked position to a less tensioned, locked position within a peripheral groove about the ends of the first and second piling bars, which groove forms the retainer-cavity means.

10. The piling bars of claim 1 wherein the housing means comprises a cylindrical housing having an inner diameter slightly larger than the outer diameter of the piling bars to be coupled and a chamfered inner edge at the one and other end of the inner diameter to ease the entry of the piling bars into the housing.

11. A structural foundation which comprises:

(a) a pipe casing disposed in a generally vertical direction in the ground;

(b) a plurality of coupled piling bars of claim 1 of defined length within and spaced apart from the interior of the pipe casing to provide a load support to a foundation, the lower end of the coupled piling bars resting on bedrock or below, and the upper end of the upper piling bars forming a support for the foundation; and (c) a hardened cement-like material within the pipe casing and surrounding the plurality of coupled piling bars.

12. The piling bars of claim 1 wherein the piling bars comprise solid metal, round bars having a diameter of from about 4 to 12 inches.

13. Coupled piling bars for use in providing a load-bearing support for a structural foundation in which the piling bars are coupled together into an axially aligned, contacting end-to-end coupled relationship, which coupled piling bars comprise:

(a) a first and a second solid metal bar, each having a one and another end, the one end of the first bar and the other end of the second bar placed in a close, substantially fully contacting, aligned, supporting coupled relationship, the one and the other ends of the first and second bars characterized by a pin-retaining peripheral groove spaced apart a defined short distance from each end of each of the bars, and a pin-retaining ring-receiving groove at each opposing end of each of the bars to receive a pin-retaining ring therein; and (b) pile-bar coupling means securing together the one end of the first bar and the other end of the second bar, which coupling means comprises (i) an outer housing having an inner diameter and surface, which housing adapted to a slidably fit in a snug manner over the one end of the first bar and the other end of the second bar, (ii) a plurality of first and second retainer pins in the housing and spaced apart a defined distance, (iii) spring tensioning means to bias the pins inwardly toward the axial center of the housing and into a pin-retaining, closed position within the pin-retaining groove, respectively, at the one end of the first bar and at the other end of the second bar, and (iv) retaining rings within the housing, the rings positioned to retain the first and second retainer pins in an open, tensioned position, prior to the insertion of the one end of the first bar and the other end of the second bar, the retainer-ring members snugly fitted into the pin-retaining ring-receiving groove at the one end of the first bar and the other end of the second bar in the loaded coupled position, thereby providing for a coupled relationship of the first and second bars within the housing, with the one end of the first bar and the other end of the second bar in a locked, coupled relationship.

14. The coupled bars of claim 13 wherein the first and second bars comprise solid, round, metal bars having a length of about 4 to 15 feet and having a diameter of about 4 to 12 inches.

15. The coupled bars of claim 13 which include three or more bars and two or more couplings, to provide a plurality of bars and couplings in a defined bar-coupling relationship.

16. A foundation for providing a structural foundation which includes a plurality of the coupled piling bars of claim 13 in a vertical relationship, to form a load-bearing support for a foundation.

17. A piling-bar coupler for coupling together the one end of a first bar and the other end of a second bar in a close, axially aligned, contacting, load-bearing, coupling relationship and suitable for use in providing a structural foundation, which piling-bar coupler comprises:

(a) an outer housing having an inner diameter and surface and which slidably fits over in a snug manner the outer diameter and surface of the opposing ends of first and second piling bars;

(b) first and second retainer pin-type members spaced apart from each other within the housing;

(c) tensioning means to bias the retainer members inwardly toward the center of the housing; and (d) moveable retainer-ring means within the housing, to retain the first and second retainer members in an open, tensioned position, so as to permit the one end of the first bar and the other end of the second bar to be slid into opposite ends of the housing and into an opposing bar-end-contacting relationship within the housing, and whereby the retainer-ring members are received in a retaining-ring cavity at the ends of the first and second bars respectively, and the retainer members of the housing move from a tensioned, biased unlocked position into a locked, position within a pin-retainer cavity at the one end of the first bar and the other end of the second bar, respectively, to place the first and second bars in a coupled, end-to-end, load-bearing relationship.

18. The coupler of claim 17 which includes a plurality of first and second pin-retaining members, the pin members generally uniformly peripherally spaced around the exterior of the housing, with the first pin members retained in an unlocked position by the first ring-retaining member, and the plurality of the second pin members retained in an unlocked, tensioned position by the second ring-retaining member in the locked or uncoupled position.

19. The coupler of claim 17 wherein the thickness of the retaining ring member is the same as or greater than the width of the retaining pins.

* * * * *